US005445386A

United States Patent [19]

Marshall

[11] Patent Number: 5,445,386

[45] Date of Patent: Aug. 29, 1995

[54] DEVICE FOR CHANGING HARDNESS OF PUTTER STRIKING FACE

[76] Inventor: Perry C. Marshall, 103 Granada Ct. North, Plant City, Fla. 33566

[21] Appl. No.: 310,128

[22] Filed: Sep. 21, 1994

[51] Int. Cl.[6] ..... A63B 69/36; A63B 53/04

[52] U.S. Cl. ..... 273/194 A; 273/78

[58] Field of Search ..... 273/167 R, 164.1, 162 R, 273/193 R, 194 R, 194 A, 194 B, 78, 173, 77 R, 187.4, 187.6, 186.2, 167 J, DIG. 30, DIG. 8

[56] References Cited

U.S. PATENT DOCUMENTS

| | | | |
|---|---|---|---|
| 2,503,506 | 4/1950 | Miller | 273/194 A |
| 2,660,436 | 11/1953 | Grossman | 273/194 A |
| 3,133,735 | 5/1964 | Greenshields | 273/173 |
| 3,401,941 | 9/1968 | Hesidence | 273/194 A |
| 3,489,415 | 1/1970 | Smith | 273/194 A |
| 4,156,526 | 5/1979 | Huggins | 273/78 |
| 4,422,638 | 12/1983 | Tucker | 273/78 |

*Primary Examiner*—Sebastiano Passaniti
*Attorney, Agent, or Firm*—Joseph C. Mason, Jr.; Ronald E. Smith

[57] ABSTRACT

A device is retrofit onto the striking face of an existing putter to change the characteristics of the striking face. In a first embodiment, the device includes a first part and a second part and the second part is bent at a ninety degree angle relative to the first part. The second part overlies a top edge of the existing putter to align the first part with the striking face of the existing putter. A first side of a double-sided pressure sensitive tape overlies the rear side of the first part and a second side of the tape is covered by a sheet of paper that is peeled off by a consumer when the device is to be attached to the existing putter. When the second side of the tape is exposed by peeling off the paper that covers it, the second side of the tape is placed into overlying relation to the striking surface of the putter to attach the first part of the device in overlying relation to the striking surface. The second part of the device overlies the putter top edge to align the first part and the striking surface. In a second embodiment, a double-sided pressure sensitive tape is used to attach a flat elastomeric member to the striking surface. Both embodiments change the characteristics of the striking face and protect the striking face from damage.

6 Claims, 1 Drawing Sheet

DEVICE FOR CHANGING HARDNESS OF PUTTER STRIKING FACE

BACKGROUND OF THE INVENTION

1. Field of the invention

This invention relates, generally, to improvements in golf putters. More particularly, it relates to a device that is removably attachable to the striking face of a putter to change its characteristics.

2. Description of the prior art

The conventional wisdom concerning how hard a putter striking face should be has changed over the years. It was once thought that the harder the striking face, the better. Thus, striking faces were made with steel having a high Rockwell hardness.

As the thinking changed, some manufacturers introduced putters having bronze or aluminum striking faces. The softer striking face was thought to provide a better "feel" at the moment the face strikes the ball.

One inventor, as disclosed in U.S. Pat. No. 4,422,638 to Tucker, even went so far as to introduce a putter having a striking face made of an elastomeric material.

Most golfers are reluctant to buy a special putter having an unusual striking face because of the expense of purchasing a new putter and because purchase of a new putter makes the prior purchase of a conventional putter a wasted expense. What is needed, then, is an inexpensive device that will enable a golfer to keep his or her old putters yet enable the modification of such putters so that they will have a softer putting face.

However, in view of the prior art when considered as a whole at the time the present invention was made, it was not obvious to those of ordinary skill in this art how such a breakthrough could be achieved.

SUMMARY OF THE INVENTION

The longstanding but heretofore unfulfilled need for a device that modifies an existing golf putter striking face to give it a softer striking surface is now fulfilled in the form of an inexpensive device that is releasably attachable to an existing golf putter striking face.

In a first embodiment, the novel device has a flat first part made of aluminum that overlies the existing putter striking face when the device is attached thereto, and a flat second part bent at a ninety degree angle to the first part. The second part is an alignment flange that overlies the upper edge of the putter blade when the novel device is properly positioned relative thereto. A peel and seal type of double-sided pressure sensitive tape is adhered to a rear surface of the first part of the device. At the time of purchase, a first side of the pressure sensitive tape is adhered to the rear side of the first part of the device, and a layer of paper is releasably adhered to the second side of said tape. The consumer simply peels off the layer of paper to expose the second side of the pressure sensitive tape, and then positions the device in overlying relation to the existing putter striking surface. The alignment flange overlies the top edge of the putter blade as aforesaid to align the device when the consumer is attaching it to the striking surface. The pressure sensitive tape strongly adheres the device to the putter so that it will not come off during practice sessions or during a round of golf, although removal is possible if a tool is used for such purpose.

In a second embodiment, an elastomeric material is provided to overlie the striking surface. As in the first embodiment, a double-sided pressure sensitive tape of the peel and seal type overlies the rear side of the device. The consumer peels off a sheet of paper that overlies the exposed part of the tape, and positions the device on the striking face. Unlike the first embodiment, no alignment flange is provided.

It should now be clear that the primary object of this invention is to provide the world's first device for softening the striking face of an existing putter by retrofitting thereto a softer striking surface.

Another important object is to provide alternative means for accomplishing said softening of said striking surface.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
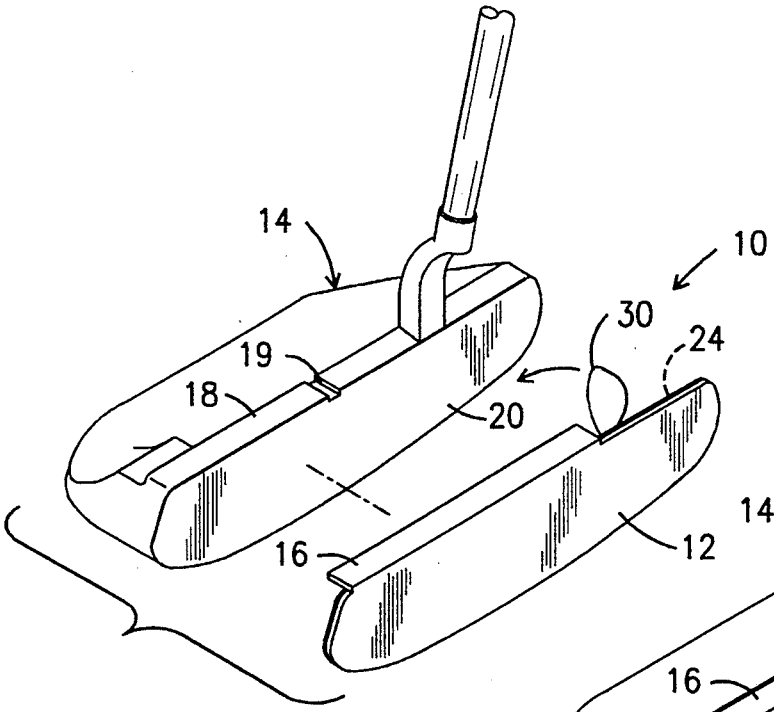
FIG. 1 is an exploded perspective view of a first embodiment of the novel device.

Referring now to FIG. 1, it will there be seen that an illustrative embodiment of the invention is denoted as a whole by the reference numeral 10.

First part 12 of device 10 is flat and has a length and height coextensive with the length and height of a putter blade 14. Device 10 is provided in differing lengths and heights so that it fits nicely with putter blades of differing lengths and heights.

Figure 2:
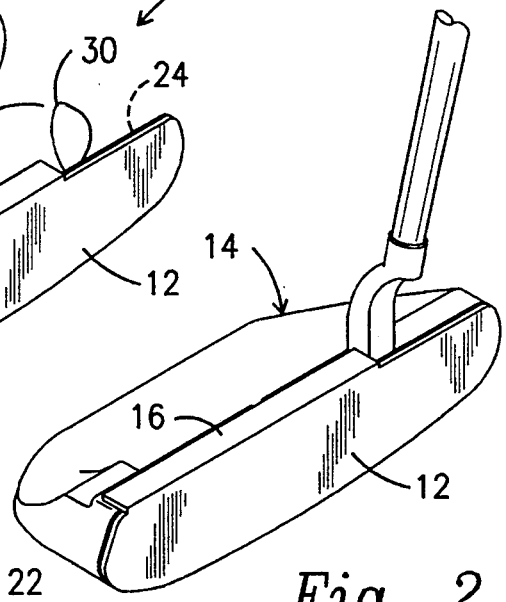
FIG. 2 is a perspective view showing the first embodiment attached to the striking face of a putter.

Second part 16 of device 10 is also flat and is formed integrally with first part 12 and is bent at a ninety degree angle relative to said first part 12. It has a depth substantially equal to the depth of top edge 18 of putter blade 14 so that it substantially overlies said top edge 18 when device 10 is attached to blade 14 as depicted in FIG. 2. When said second part 16 is positioned in overlying relation to said putter top edge 18, first part 12 of device 10 is positioned in overlying relation to striking surface 20 of putter blade 14.

A double-sided pressure sensitive tape 22 has a first side adhered to rear side 24 of first part 12, and a second side covered by a flexible sheet of material 30 that is peelable therefrom as indicated in FIG. 1. In the tape industry, such tape is known as "peel and seal" tape because peelable sheet 30 protects the second side of the tape until said sheet is peeled off. When a consumer buys novel device 10, the first side of tape 22 is already secured to rear side 24 of first part 12, and the second side of tape 22 is covered by paper 30. Thus, to use device 10, the consumer peels off paper 30 to expose the second side of tape 22, and places second part 16 of device 10 into overlying relation to top edge 18 of putter blade 14 to thereby align said first part 12 and said striking surface 20 of blade 14; the exposed second side of tape 22 is then brought into adhering relation to striking surface 20 and installation is complete.

Attachment of device 10 in overlying relation to striking surface 20 of blade 14 has numerous advantages.

First of all, device 10 is made of aluminum and therefore has a hardness less than that of brass or steel. Thus, the hardness of the conventional steel striking surface 20 is replaced by a softer striking surface to improve the feel of a putt.

Secondly, the attachment of device 10 serves as a protective means for striking surface 20, ensuring that it will last longer than it would have but for such protection. Device 10 takes the blows and other forces that would otherwise produce wear and tear in striking surface 20. Since device 10 will retail for about ten dollars or thereabouts, it can be replaced when worn for far less than the replacement cost of putter blade 14.

Thirdly, the attachment of device 10 in overlying relation to striking surface 20 serves to refurbish the existing putter, i.e., it serves as a repair means for those striking surfaces already deteriorated from the effects of wear and tear.

Moreover, first part 12 may be milled or left unmilled to provide consumers with their choice; some golfers believe a striking surface that has been milled provides some benefits, especially for those golfers who "cut" the ball during a stroke, i.e., who hit the ball nonsquarely.

Novel device 10 may also be removed, albeit with some difficulty. Thus, attaching it to a putter blade does not permanently remove that putter blade from use.

Interestingly, the novel device 10 also enables each golfer to find and mark the sweet spot of the putter. Many conventional putters are provided with sweet spot markers on the top edge of the putter blade, but such markers are sometimes out of alignment with the actual sweet spot of the putter. The sweet spot may be found for an individual putter by placing its striking surface in a horizontal plane, and dropping a golf ball on various points thereon and observing the bounce provided by each point. The spot that provides the greatest bounce is the sweet spot. Alternatively, the putter blade may be positioned in a horizontal plane and balanced on a sharp edge to determined its center of balance or center of gravity; such location is also the sweet spot of the blade. Thus, a putter having novel device 10 attached thereto may be tested in both of these ways to determined the sweet spot of first part 12. When it is found, second part 16 is marked. Significantly, second part 16 obscures the manufacturer's marker because, as is clear from FIG. 2, said second part overlies putter blade top edge 18 as aforesaid; this is desireable because the manufacturer's sweet spot marker (denoted 19 in the Figs.) will usually be off at least to some degree because mass produced putter blades have the same mass produced sweet spot marker even though the blades differ from blade to blade and have different sweet spots.

Figure 3:
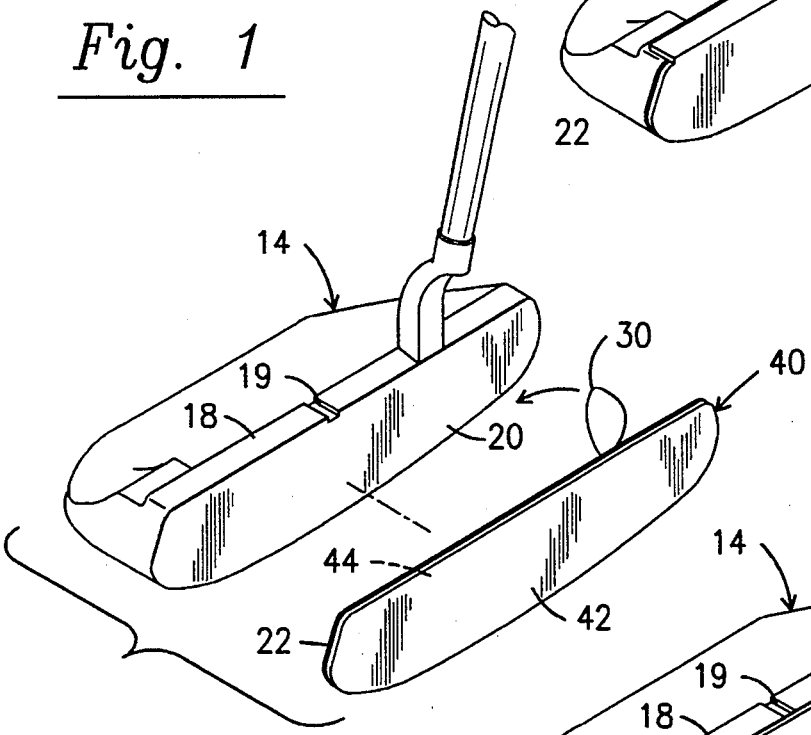
FIG. 3 is an exploded perspective view of a second embodiment of the novel device.
Figure 4:
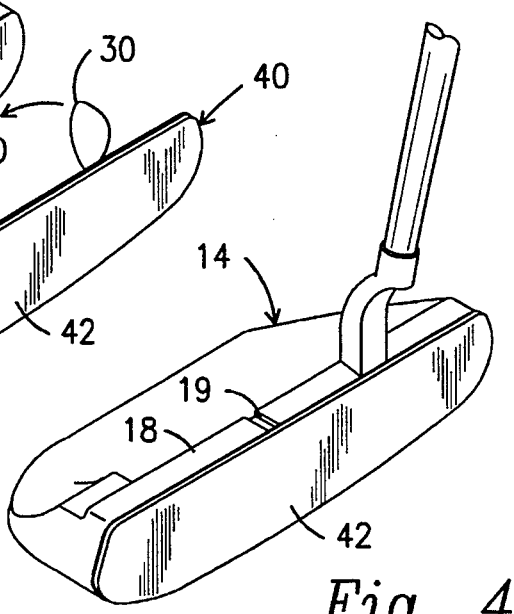
FIG. 4 is a perspective view showing the second embodiment attached to the face of a putter.

In a second embodiment of the invention, depicted in FIGS. 3 and 4, alignment flange 16 is not used. Instead, the second embodiment includes base member 40 which is made of an elastomeric material such as rubber or a synthetic substitute. Base member 40 has a first side 42 which serves as a striking surface when said base member is attached to preexisting putter blade 14, and a second side 44 to which is adhered the first side of a double-sided pressure sensitive tape 22. As in the first embodiment, the second side of said tape 22 is covered by a peelable sheet 30 when this embodiment is purchased. The consumer peels off sheet 30 as suggested in FIG. 3 and attaches base member 40 to striking surface 20 of putter blade 14; no alignment means is provided.

As in the first embodiment, base member 40 is provided in multiple sizes and shapes to fit multiple putter blades. Base member 40 is removable from the preexisting striking surface, with some difficulty; like the first embodiment, it also protects the preexisting striking surface and refurbishes the putter blade.

The preferred durometer reading of base member 40 is about 90 Shore D.

This second embodiment provides a very soft feel and is suitable for use on particularly fast greens. It also seems to benefit players who "cut" the ball during their stroke.

Significantly, both embodiments enable a golfer to modify the characteristics of the golfer's preexisting putters without requiring the golfer to discontinue use of said putters. Perhaps even more importantly, the very low cost of both embodiments of the novel device enables a golfer to protect and refurbish all older clubs at an expense far below the replacement cost of a new putter.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device that changes the characteristics of the striking face of a putter, comprising:

a first part of flat construction, said first part made of a preselected material having a hardness different from a hardness of a putter, and said first part having a front surface and a rear surface;

alignment means for aligning said first part with a striking surface of a putter so that said first part is placed into overlying relation to said striking surface;

said alignment means having a second part of flat construction, said second part made of the same preselected material as said first part and said second part being formed integrally with said first part;

said second part being bent at a ninety degree angle relative to a plane containing said first part;

said second part having a depth sufficient to overlie a top edge of a putter; and means for attaching said rear surface of said first part to a striking surface of a putter;

whereby the characteristics of a striking face are changed upon attachment of a device to said putter.

2. The device of claim 1, wherein said attachment means is a double-sided pressure sensitive tape having a first side secured to said rear surface of said first part and having a peelable paper overlying a second side of said tape.

3. The device of claim 1, wherein said preselected material is aluminum.

4. The device of claim 1, wherein said second part has a length less than a length of said first part.

5. The device of claim 1, wherein said first part has a hardness less than that of brass or steel.

6. The device of claim 1, further comprising a marker on said second part that indicates the sweet spot of the putter when said device is attached thereto.

* * * * *